US010211552B2

(12) United States Patent
Zhu et al.

(10) Patent No.: US 10,211,552 B2
(45) Date of Patent: Feb. 19, 2019

(54) CABLE CONNECTOR ASSEMBLY HAVING SPACE-SAVING CONNECTION BETWEEN CABLE WIRE CONDUCTORS AND CONTACT TERMINATING PORTIONS

(71) Applicant: FOXCONN INTERCONNECT TECHNOLOGY LIMITED, Grand Cayman (KY)

(72) Inventors: Zheng-Rong Zhu, Kunshan (CN); Jun Chen, Kunshan (CN); Jerry Wu, New Taipei, CA (US)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/790,086

(22) Filed: Oct. 23, 2017

(65) Prior Publication Data

US 2018/0115095 A1 Apr. 26, 2018

(30) Foreign Application Priority Data

Oct. 21, 2016 (CN) ..... 2016 1 0918500
Oct. 21, 2016 (CN) ..... 2016 1 0918511

(51) Int. Cl.
*H01R 12/65* (2011.01)
*H01R 12/59* (2011.01)
(Continued)

(52) U.S. Cl.
CPC ..... *H01R 12/65* (2013.01); *H01R 12/592* (2013.01); *H01R 13/5833* (2013.01);
(Continued)

(58) Field of Classification Search
CPC ..... H01R 12/65; H01R 13/5845; H01R 13/5833; H01R 24/28; H01R 12/592; H01R 2107/00; H01R 4/023; H01R 4/06
(Continued)

(56) References Cited

U.S. PATENT DOCUMENTS 3,120,985 A * 2/1964 Hubbell ..... H01R 13/6453 439/166
3,950,069 A * 4/1976 Wiley ..... H01R 13/56 439/694
(Continued)

FOREIGN PATENT DOCUMENTS

CN 2857255 1/2017

*Primary Examiner* — Travis Chambers
(74) *Attorney, Agent, or Firm* — Wei Te Chung; Ming Chieh Chang

(57) ABSTRACT

A cable connector assembly includes: an insulative base (1); plural contacts secured to the insulative base, each contact having a contacting portion, a terminating portion, and a securing portion between the contacting portion and the terminating portion; a cable including plural wires connected to the contacts, each wire having a center conductor; and an outer shell enclosing the insulative base and a part of the cable; wherein the contact terminating portion has a groove (2021) receiving the cable wire center conductor; and the cable wire center conductor extends to terminate perpendicularly to an associated contact. Plural interconnecting pieces each secured to an associated cable wire center conductor are also designed to replace direct connection of the cable wires to the contacts.

13 Claims, 14 Drawing Sheets

(51) Int. Cl.

| | |
|---|---|
| ***H01R 13/58*** | (2006.01) |
| ***H01R 24/28*** | (2011.01) |
| *H01R 4/02* | (2006.01) |
| *H01R 4/06* | (2006.01) |
| *H01R 107/00* | (2006.01) |

(52) U.S. Cl.
CPC ..... *H01R 13/5845* (2013.01); *H01R 24/28* (2013.01); *H01R 4/023* (2013.01); *H01R 4/06* (2013.01); *H01R 2107/00* (2013.01)

(58) Field of Classification Search
USPC ..... 439/495, 398, 492, 494, 496, 409, 417
See application file for complete search history.

(56) References Cited

U.S. PATENT DOCUMENTS 4,753,608 A * 6/1988 Yamaguchi ..... H01R 12/675 439/395
4,772,212 A * 9/1988 Sotolongo ..... H01R 12/775 439/98
4,824,384 A * 4/1989 Nicholas ..... H01R 43/28 439/108
5,100,342 A * 3/1992 Olsson ..... H01R 13/41 439/497
5,759,069 A 6/1998 Hosiden
5,928,029 A * 7/1999 Lam ..... H01R 12/777 439/495
6,030,722 A * 2/2000 Kuboshima ..... H01M 2/206 429/178
6,604,957 B2 * 8/2003 Comini ..... H01R 4/242 439/417
6,824,412 B2 * 11/2004 Clement ..... H01R 13/20 439/290
6,945,829 B2 * 9/2005 Finzer ..... F16B 29/00 411/437
2004/0029431 A1 * 2/2004 Comini ..... H01R 4/2458 439/417
2013/0034988 A1 * 2/2013 Turco ..... F21V 21/002 439/417

* cited by examiner

CABLE CONNECTOR ASSEMBLY HAVING SPACE-SAVING CONNECTION BETWEEN CABLE WIRE CONDUCTORS AND CONTACT TERMINATING PORTIONS

BACKGROUND OF THE INVENTION

1. Field of the Invention

The present invention relates to a cable connector assembly having cable wire conductors coupled to contact terminating portions in a way that saves space.

2. Description of Related Art

China Patent No. 2857255 discloses a plug cable connector assembly including an insulative base, a plurality of contacts secured to the insulative base, plural cable wires connected to the contacts, and an insulative outer shell enclosing the insulative base and a part of the cable. A terminating portion of the contact has an axial groove receiving a center conductor of a corresponding cable wire. To have a stable connection, the axial groove has to be sufficiently long, which increases a dimension of the assembly.

SUMMARY OF THE INVENTION

A cable connector assembly comprises: an insulative base; plural contacts secured to the insulative base, each contact having a contacting portion, a terminating portion, and a securing portion between the contacting portion and the terminating portion; a cable including plural wires connected to the contacts, each wire having a center conductor; and an outer shell enclosing the insulative base and a part of the cable; wherein the contact terminating portion has a groove receiving the cable wire center conductor; and the cable wire center conductor extends to terminate perpendicularly to an associated contact. Plural interconnecting pieces each secured to an associated cable wire center conductor are also designed to replace direct connection of the cable wires to the contacts. In such case, the contact terminating portion has a riveting end riveted to an associated interconnecting piece.

DETAILED DESCRIPTION OF THE PREFERRED EMBODIMENT

Figure 1:
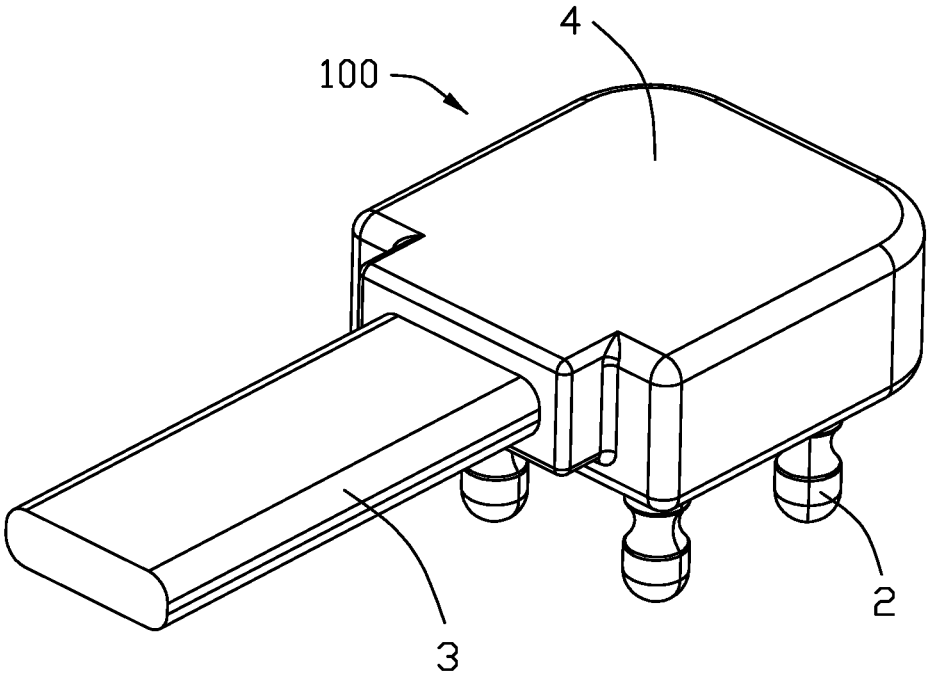
FIG. 1 is a perspective view of a cable connector assembly in accordance with a first embodiment of the present invention.
Figure 2:
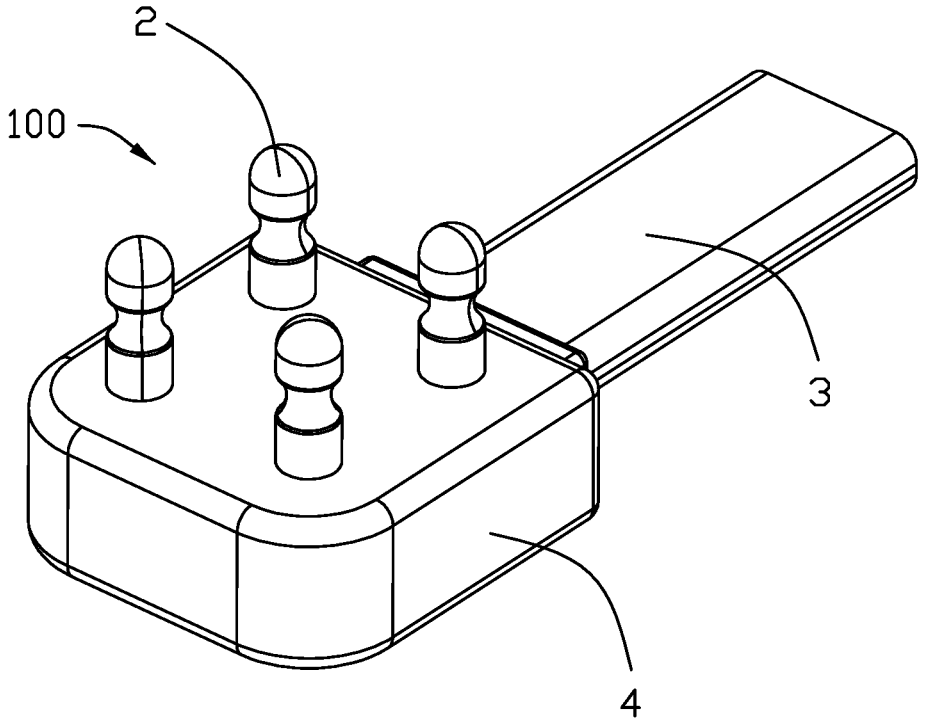
FIG. 2 is another perspective view of the cable connector assembly.
Figure 3:
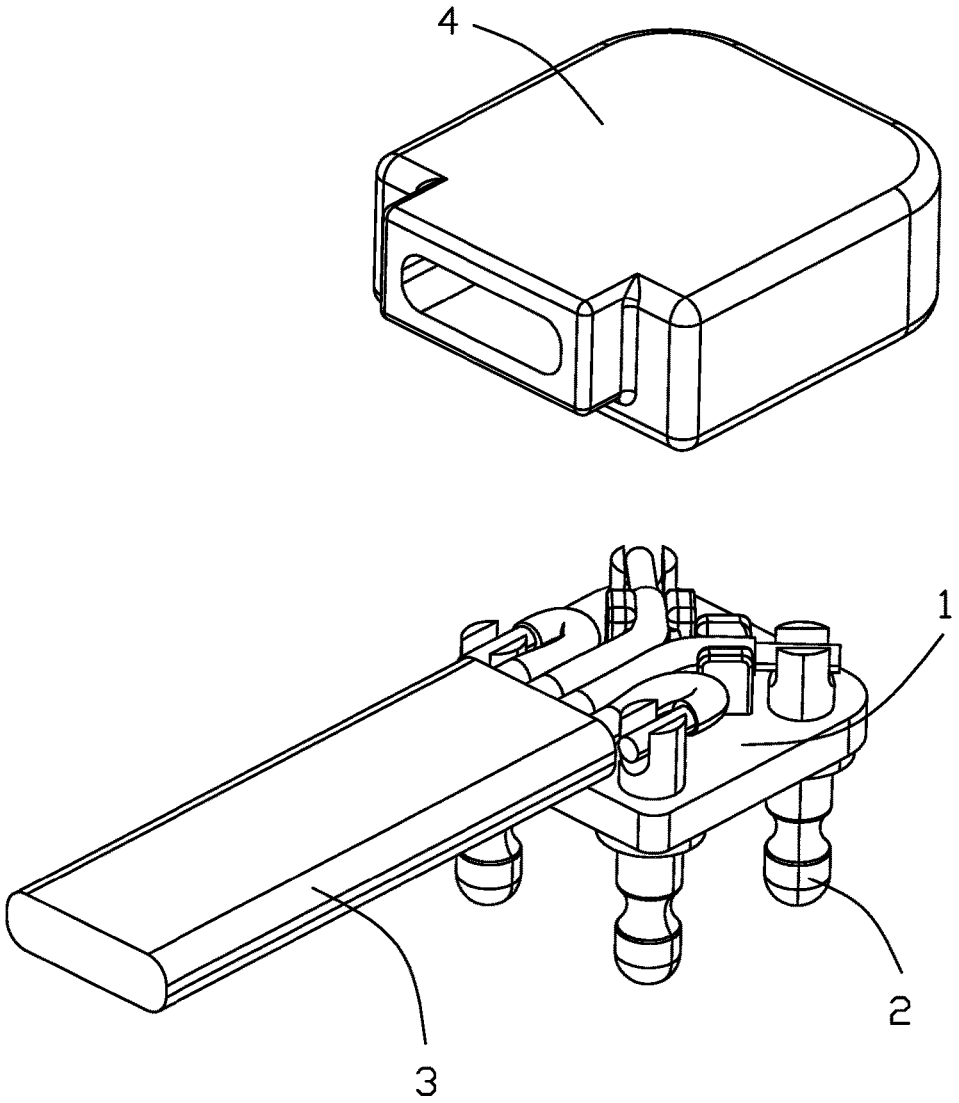
FIG. 3 is an exploded view of the cable connector assembly.
Figure 4:
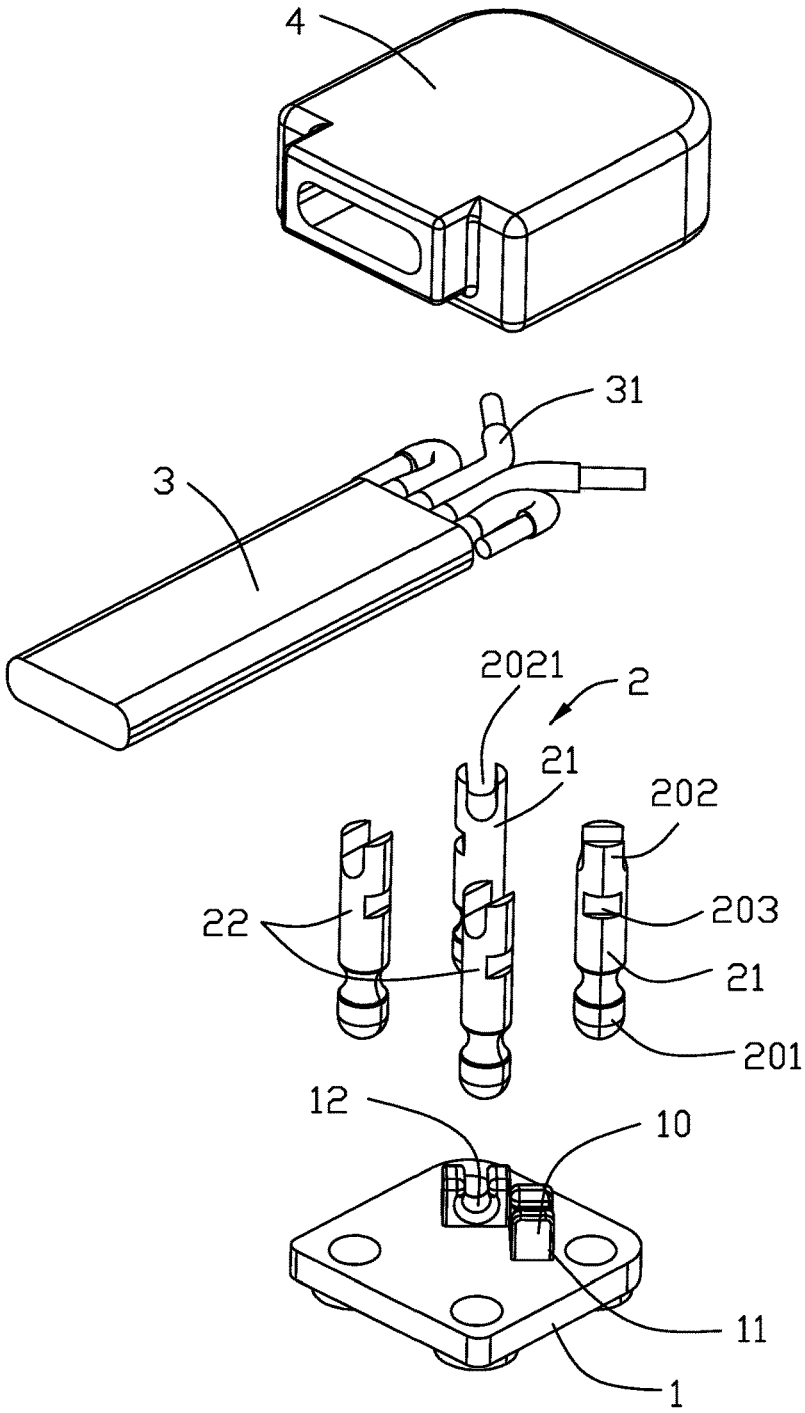
FIG. 4 is a further exploded view of the cable connector assembly.
Figure 5:
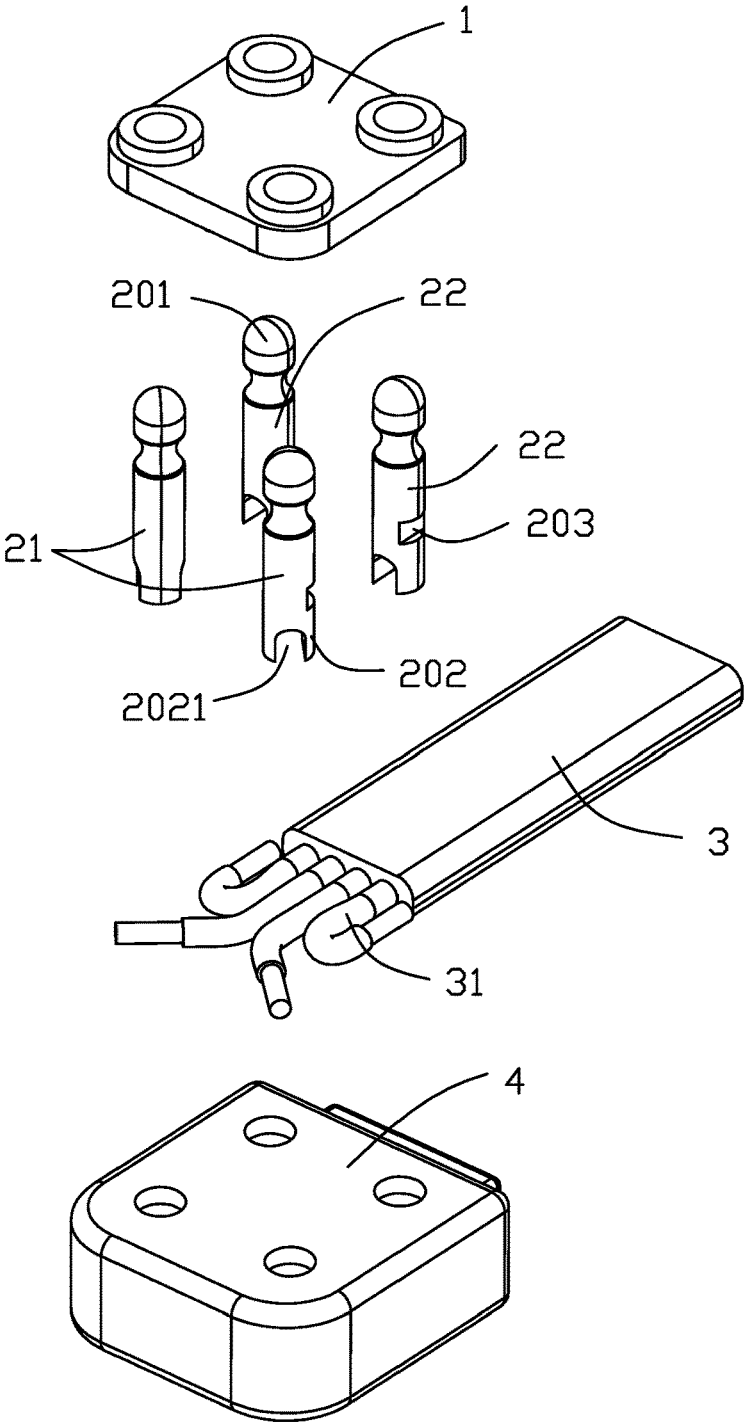
FIG. 5 is a view similar to FIG. 4 but from a different perspective.
Figure 6:
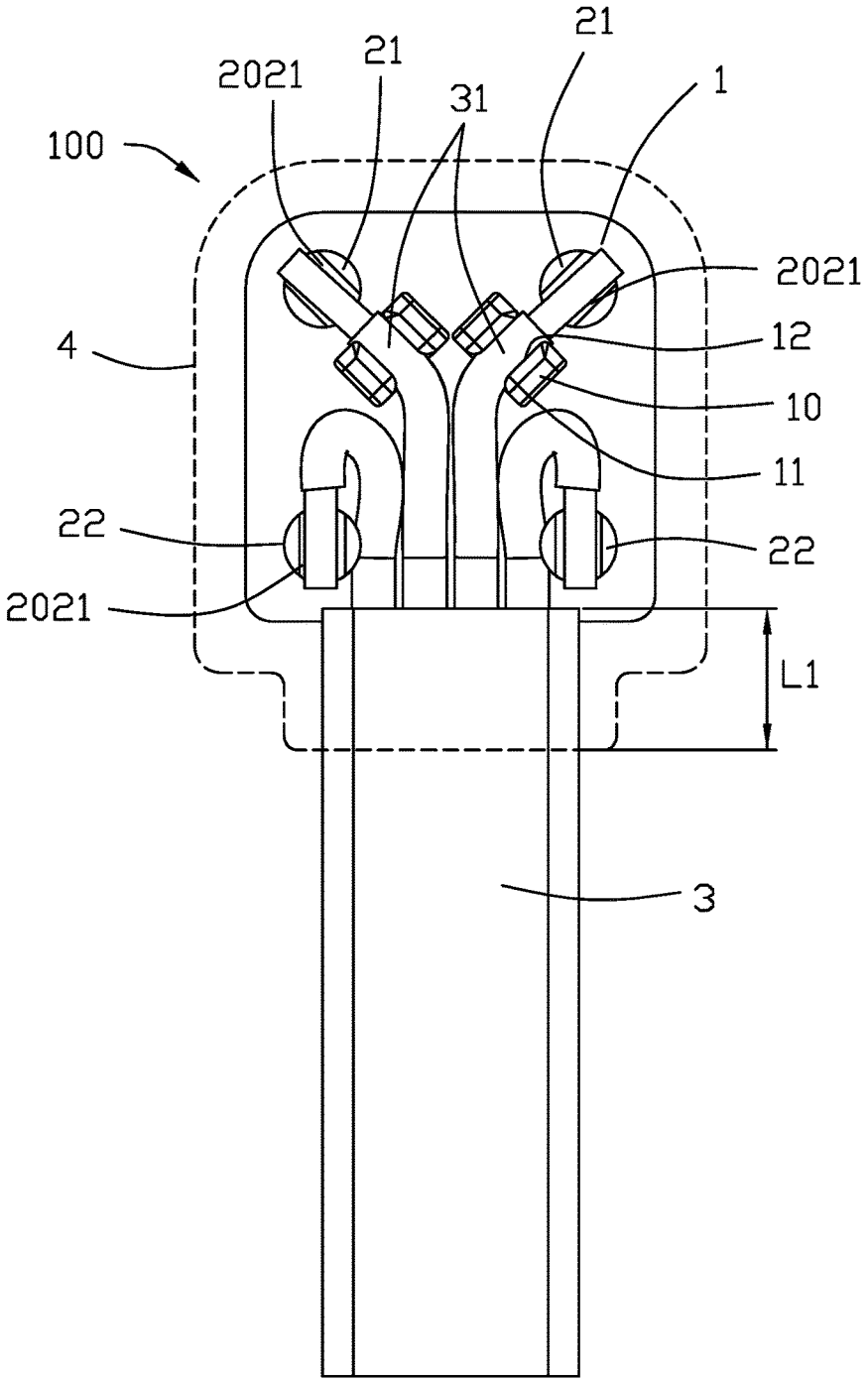
FIG. 6 is top plan view of the cable connector assembly.

Referring to FIGS. 1-6, a cable connector assembly 100 of the first embodiment includes an insulative base 1, a plurality of contacts 2 secured to the insulative base 1 via an insert-molding process, a cable 3 connected to the contacts 2, and an outer shell 4 enclosing the insulative base 1 and a part of the cable 3.

The insulative base 1 is flat and is of a square cross-section from a top view. The insulative base 1 has a pair of positioning blocks 10. Each block 10 has a body 11 and a channel 12. The channel 12 extends in a direction parallel to a general plane of the base and forming an acute angle relative to an extending or axial direction of the cable 3.

The contacts 2 are arranged perpendicular to the general plane of the base 1. The contacts 2 include a first pair of outer/farther contacts 21 distal from the cable 3 and a second pair of inner/nearer contacts 22 proximal to the cable 3. The pair of positioning blocks 10 of the insulative base 1 are disposed between the first pair of contacts 21 and the second pair of contacts 22 and are closer to the first pair of contacts 21 than to the second pair of contacts 22. Each contact 2 has a contacting portion 201, a terminating portion 202, and a securing portion 203 between the contacting portion 201 and the terminating portion 202. Notably, the securing portion 203 forms a slot receiving material of the base 1 to prevent movement of the contact 2 relative to the base 1 not only in the mating direction but also in a rotational manner. The contact terminating portion 202 has a groove 2021 extending in a diametrical direction thereof and opening through a free end thereof. The groove 2021 of the contact 21 extends in an acute angle relative to the axial direction of the cable 3. The grooves 2021 of the first pair of contacts 21 extend in a diverging manner away from the cable 3. The groove 2021 of the contact 22 may extend parallel to the axial direction of the cable 3.

The cable 3 is flat and includes a row of wires 31 connected to the contacts 2. The center conductor of the wire 31 is received in the groove 2021 and may be further soldered therein. The pair of wires 31 to be connected to the first pair of contacts 21 pass through the channels 12 of the positioning blocks 10 first. The pair of wires 31 to be connected to the second pair of contacts 22 extend between and past the contacts 22 and then turn back to be received in the grooves 2021. The pair of wires 31 to be connected to the first pair of contacts 21 are disposed between the pair of wires 31 to be connected to the second pair of contacts 22.

The outer shell 4 is molded or mounted to the insulative base 1 and the cable 3. The outer shell 4 has a main part and a strain relief. A length L1 from a rearmost end of the strain relief to a frontmost end of the jacket of the cable 3 is about 5.5 mm.

The above arrangement of connection between the cable wires 31 and the contacts 2 efficiently utilizes the space so as to obtain a shortened length of the assembly 100. Additionally, because the inner cable wires 31 are folded so as to have the similar length with the outer cable wires 31, thus resulting in the similar long transmission path for all four contacts 2.

Figure 7:
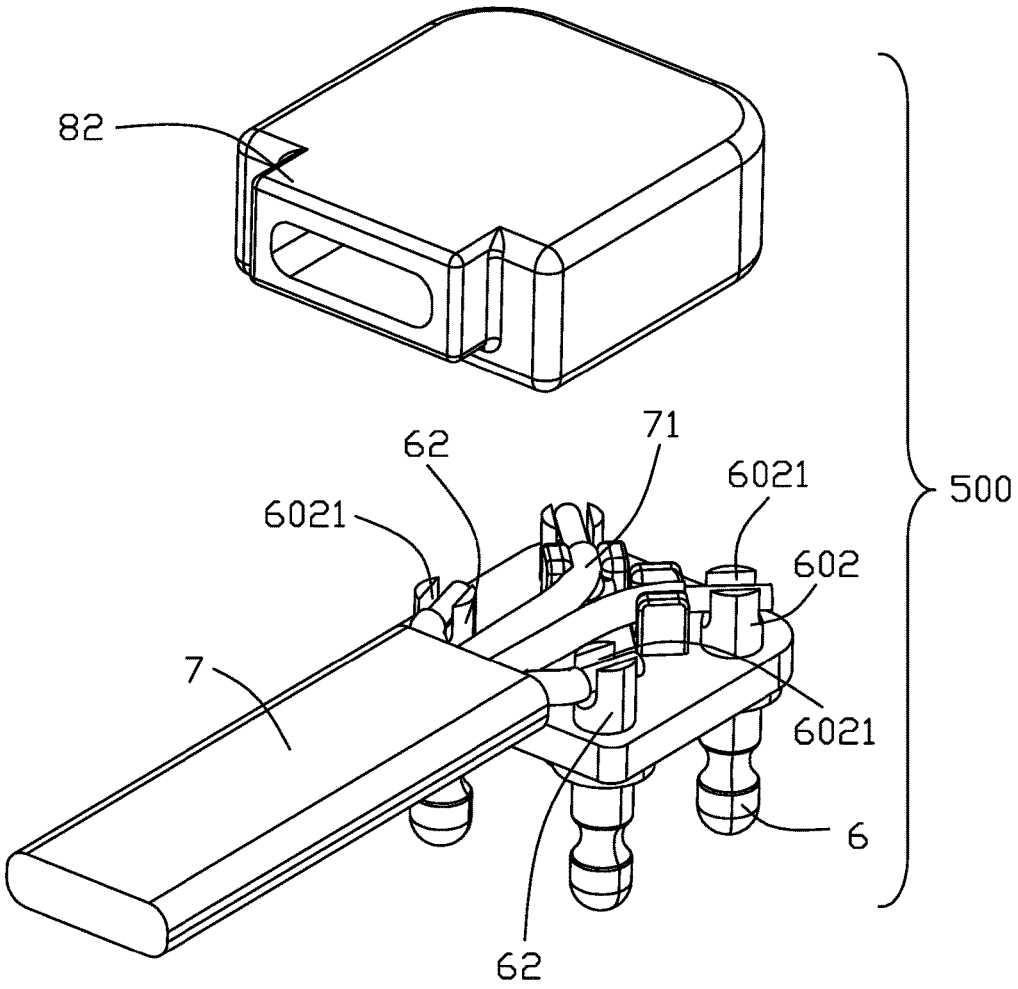
FIG. 7 is an exploded view of a cable connector assembly in accordance with a second embodiment of the present invention.
Figure 8:
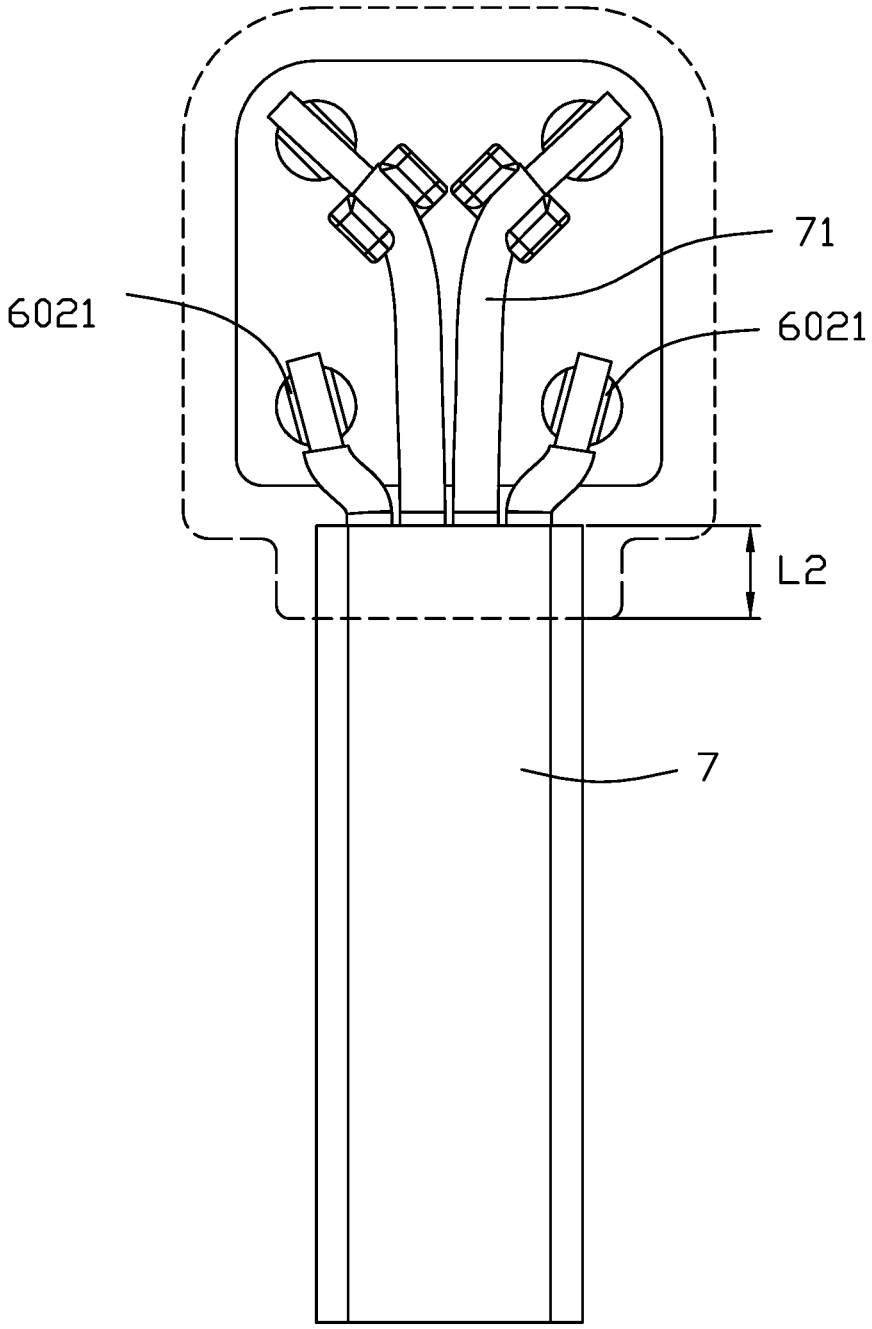
FIG. 8 is top plan view of the cable connector assembly in FIG. 7.
Figure 9:
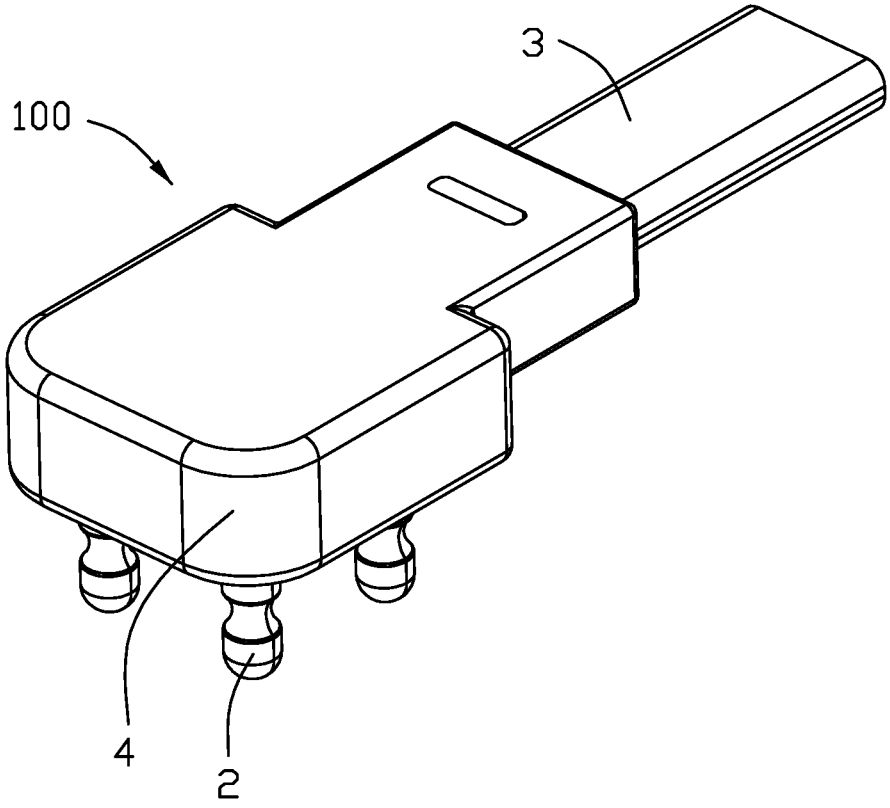
FIG. 9 is a perspective view of a cable connector assembly in accordance with a third embodiment of the present invention.
Figure 10:
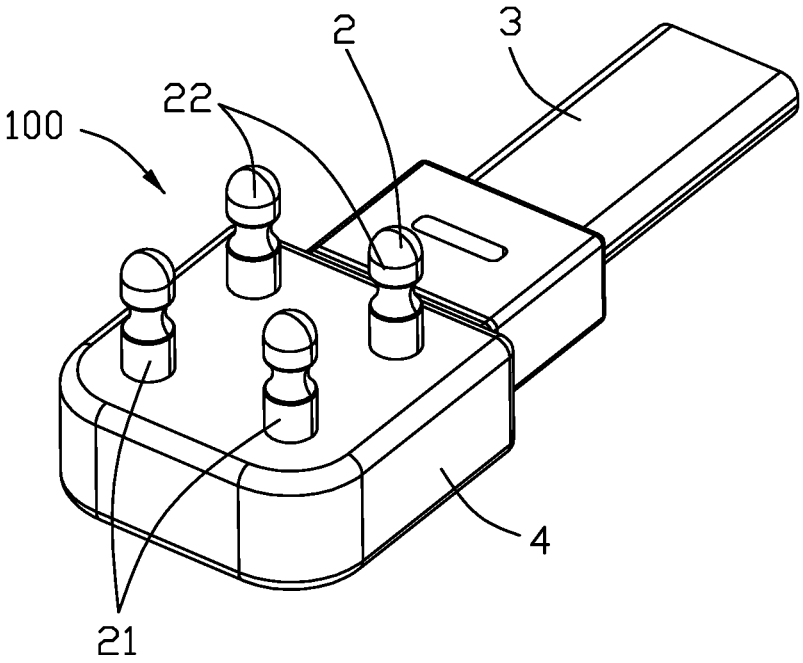
FIG. 10 is another perspective view of the cable connector assembly in FIG. 9.
Figure 11:
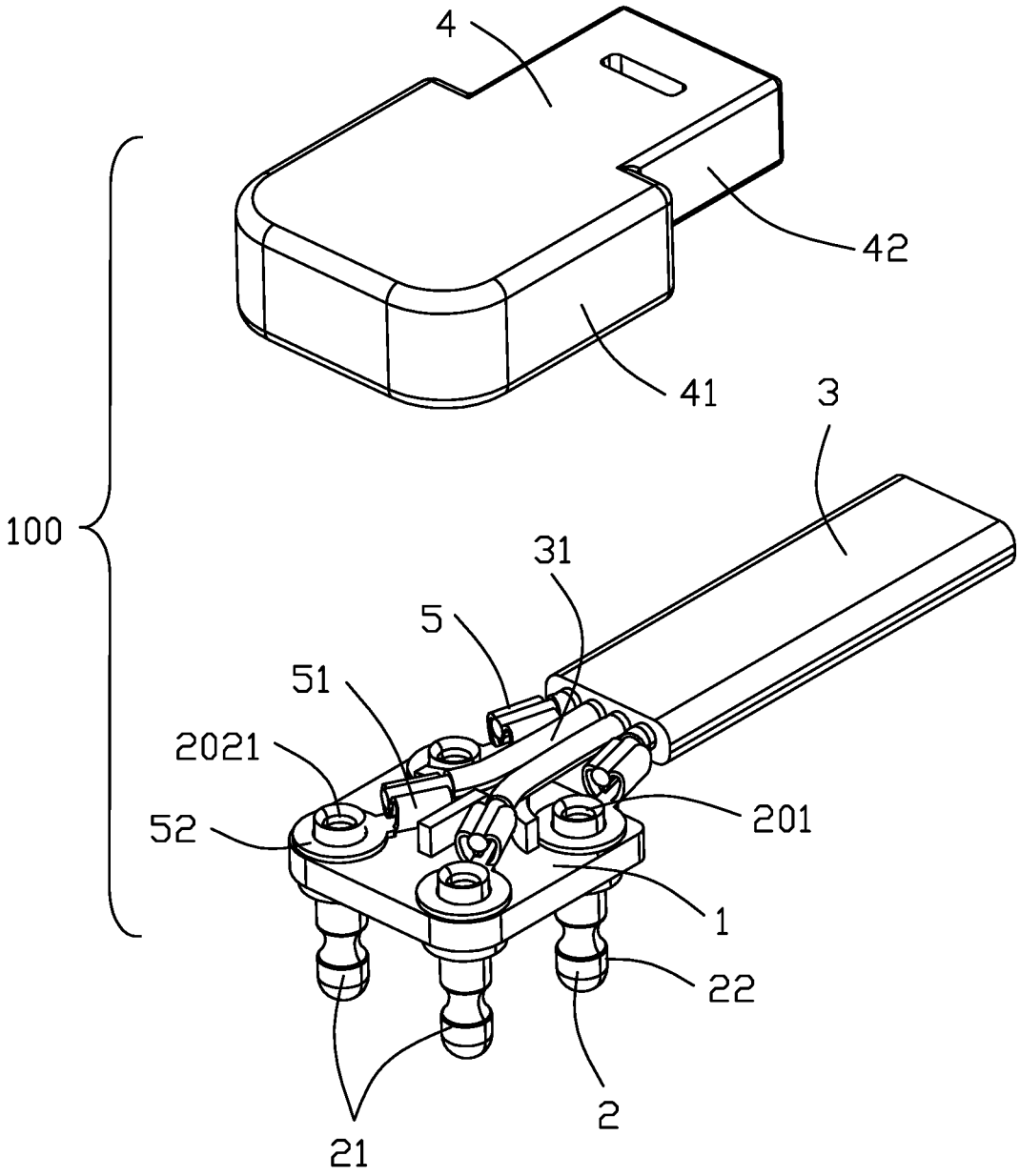
FIG. 11 is an exploded view of the cable connector assembly in FIG. 9.
Figure 12:
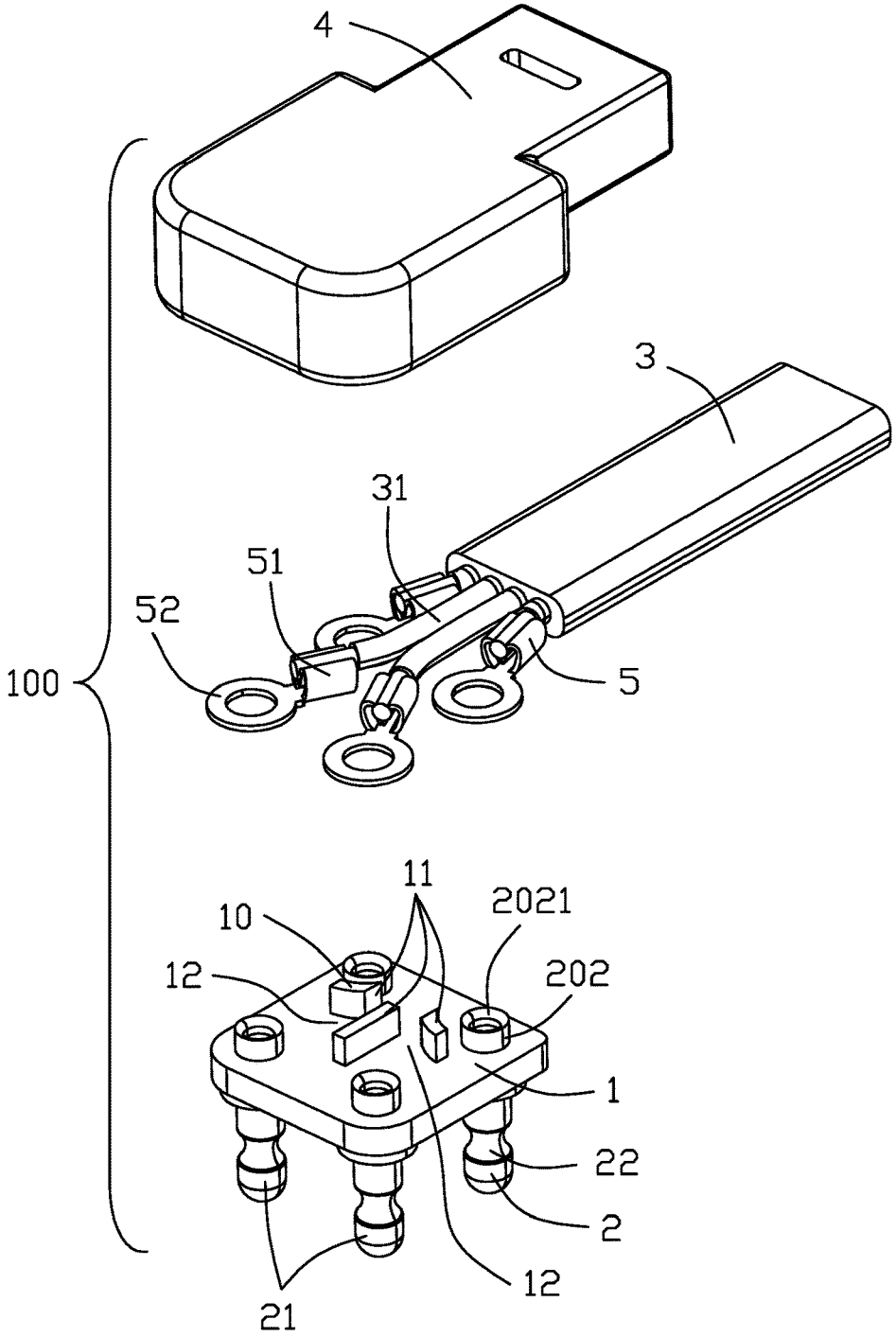
FIG. 12 is a further exploded view of the cable connector assembly in FIG. 11.
Figure 13:
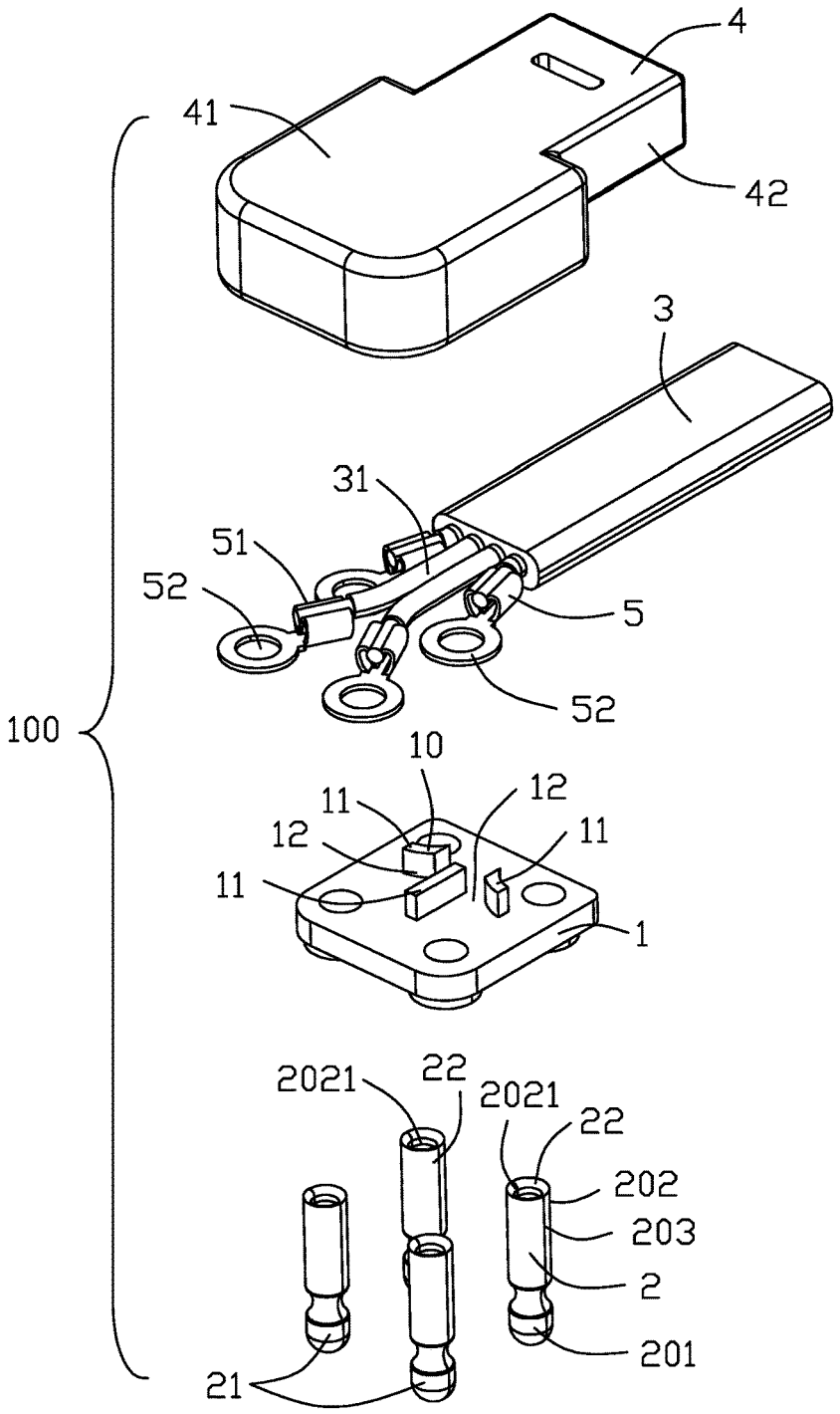
FIG. 13 is a further exploded view of the cable connector assembly in FIG. 12.
Figure 14:
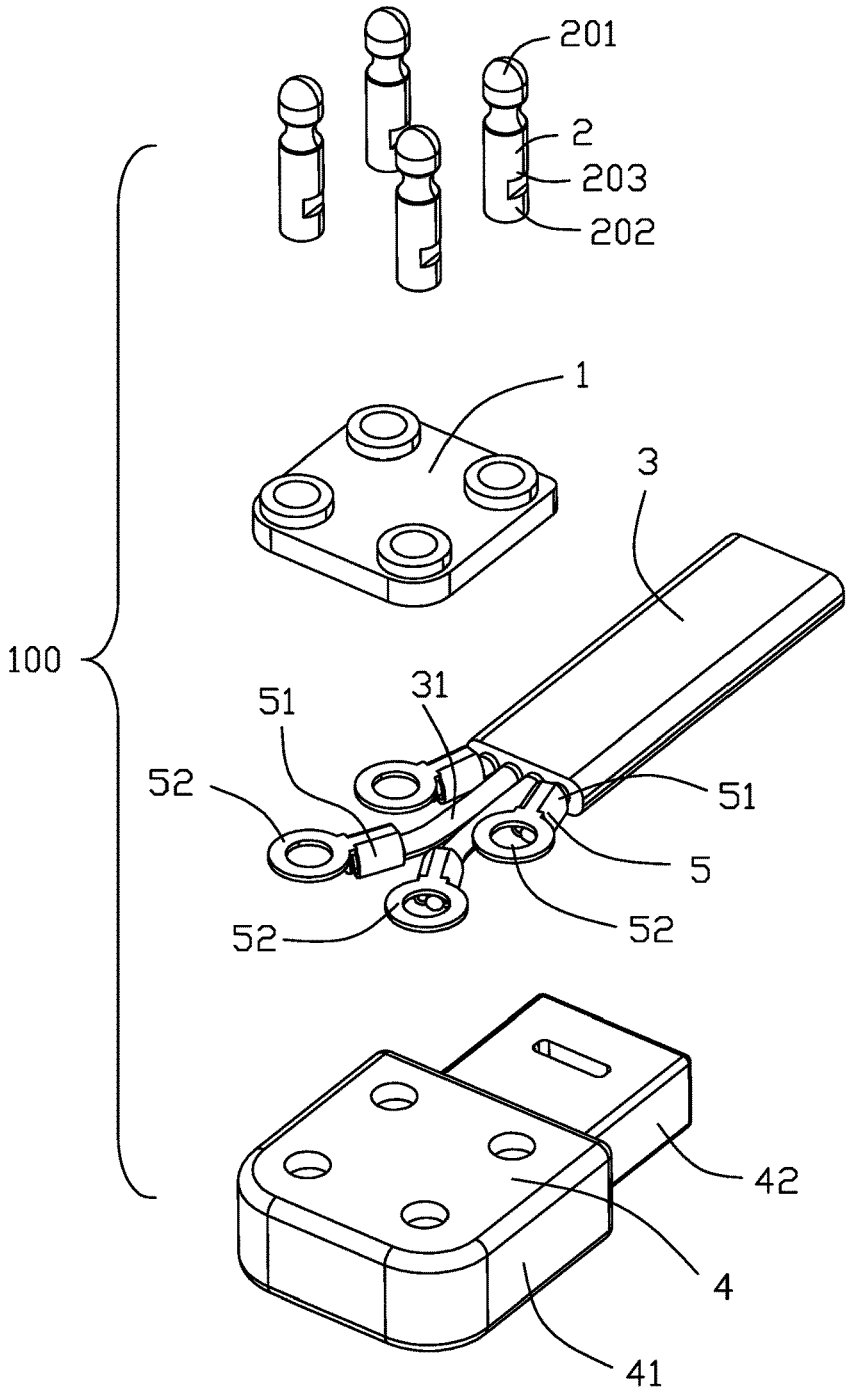
FIG. 14 is a view similar to FIG. 13 but from a different perspective.

Referring to FIGS. 7-8, in a cable connector assembly 500 of the second embodiment, corresponding groove 6021 on a terminating portion 602 of each of a second pair of contacts 62 extends in an acute angle relative to an axial direction of a cable 7. Cable wires 71 to be connected to the second pair of contacts 62 are received in the grooves 6021 straightforwardly without a U-turn.

The above arrangement of the second embodiment is suitable for thicker wires. A length L2 from a rearmost end of a strain relief 82 to a frontmost end of the jacket of the cable 7 is about 3.5 mm.

In both embodiments the cable wires 31 and 71 do not route over the terminating portions 202 and 602 of the contacts 2 and 6. Also, the contacts 2 and 6 may suitably be pin poles arranged in a square shape.

Referring to FIGS. 9-14, a cable connector assembly of the third embodiment comprises a plurality of interconnecting pieces 5 each secured to an associated cable wire center conductor for further connecting to the contact, instead of a direct connection of the cable wires to the contacts.

The contacts 2 may be cylindrical pin poles. The terminating portion 202 of each contact 2 includes a riveting end having an axial groove 2021.

The interconnecting piece 5 has a securing portion 51 and a riveting portion 52. The riveting portion 52 has a hole receiving the riveting end of the contact terminating portion 202. The securing portion 51 is fastened to exposed cable wire center conductor. After placing the riveting portion 52 onto the terminating portion 202, the terminating portion 202 with the hole is riveted against the portion 52, thus establishing mechanical and electrical connection. Additional orientation of the riveting portion 52 relative to the terminating portion 202 is not necessary.

In this embodiment, again, the outer shell 4 having the main part 41 and the strain relief 42 may be molded or mounted to the insulative base 1 and a part of the cable 3. Also, the contacts 2 and 6 may suitably be pin poles arranged in a square shape. The above arrangement of connection between the cable wires 31 and the contacts 2 through the interconnecting pieces 5 efficiently utilizes the space so as to obtain an assembly 100 of a reduced thickness.

In brief, the invention is to provide an electrical connector with four contacts at four corners of the square base wherein each contact extends and mates along the mating (front-to-back) direction while the cable extends along a vertical direction perpendicular to the front-to-back direction. The cable includes a pair of inner wires, for connecting to the farther/outer contacts, and a pair of outer wires, for connecting to the nearer/inner contacts, arranged with each other along a transverse direction perpendicular to both the front-to-back direction and the vertical direction, and approaches the contacts from one side edge of the base The base optionally forms at least a pair of positioning block around the outer/farther contacts for positioning the corresponding two inner wires. The inner wires may be folded so as to achieve the same transmission length with the outer wires for consistent electronic characteristic consideration.

What is claimed is:

1. A cable connector assembly comprising:

an insulative base;

a plurality of contacts secured to the insulative base, each contact having a contacting portion, a terminating portion, and a securing portion between the contacting portion and the terminating portion;

a cable including plural wires connected to the contacts, each wire having a center conductor;

a plurality of interconnecting pieces each secured to an associated cable wire center conductor; and an outer shell enclosing the insulative base and a part of the cable; wherein the contact terminating portion has a riveting end riveted to an associated interconnecting piece.

2. The cable connector assembly as claimed in claim 1, wherein the cable is flat.

3. The cable connector assembly as claimed in claim 1, wherein the plurality of contacts comprise four pin poles arranged in a square shape.

4. The cable connector assembly as claimed in claim 1, wherein the interconnecting piece has a securing portion and a riveting portion, the riveting portion having a hole receiving the riveting end of the contact terminating portion.

5. The cable connector assembly as claimed in claim 1, wherein the contact comprises a pin pole, and the riveting end of the pin pole has an axial groove.

6. A cable connector assembly comprising:

a planar square insulative base;

a cable extending from one side edge of said base in a vertical direction;

four contacts secured to four corners of the base, respectively, said four contacts including a pair of outer contacts farther from said side edge, and a pair of inner contacts near to said side edge, each of said contacts extending along a front-to-back direction perpendicular to a primary plane defined by said base and said vertical direction; and said cable including four wires side by side densely arranged with one another along a transverse direction perpendicular to both the vertical direction and the front-to-back direction; wherein said four wires include two inner wires respectively connected to the pair of outer contacts, and two outer wires located by two sides of the two inner wires in the transverse direction and respectively connected to the pair of inner contacts.

7. The cable connector assembly as claimed in claim 6, wherein each of said contacts forms a slot for retaining to the base so as to prevent rotation and axial movement of the contact relative to the base.

8. The cable connector assembly as claimed in claim 6, wherein the base forms a positioning block to regular the outer wires.

9. The cable connector assembly as claimed in claim 6, wherein the inner wires are folded.

10. The cable connector assembly as claimed in claim 6, wherein said four contacts are symmetrical with regard to a center of the base.

11. The cable connector assembly as claimed in claim 6, wherein each of said contacts forms a groove to receive an inner conductor of the corresponding wire.

12. The cable connector assembly as claimed in claim 6, wherein each of said wires is equipped with a riveting portion to connect to the corresponding contact.

13. The cable connector assembly as claimed in claim 6, further including an insulative outer shell applied upon the base to cover connection between the contacts and the wires.

* * * * *